US009569925B1

(12) United States Patent
Showers et al.

(10) Patent No.: US 9,569,925 B1
(45) **Date of Patent: *Feb. 14, 2017**

(54) DISTRIBUTED SECRETS FOR VALIDATION OF GAMING TRANSACTIONS

(71) Applicant: Versata Development Group, Inc., Austin, TX (US)

(72) Inventors: Brian Showers, Palo Alto, CA (US); Graham Prud'homme, Palo Alto, TX (US); Daniel S. Gindikin, Princeton Junction, NJ (US); Kyle A. Oppenheim, Mountain View, CA (US)

(73) Assignee: Versata Development Group, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/320,027

(22) Filed: Jun. 30, 2014

Related U.S. Application Data

(63) Continuation of application No. 13/560,694, filed on Jul. 27, 2012, now Pat. No. 8,764,559, which is a continuation of application No. 11/234,903, filed on Sep. 26, 2005, now Pat. No. 8,231,462, which is a continuation of application No. 09/740,325, filed on Dec. 18, 2000, now Pat. No. 6,949,022.

(60) Provisional application No. 60/252,779, filed on Nov. 22, 2000.

(51) Int. Cl.
*G07F 17/32* (2006.01)

(52) U.S. Cl.
CPC ..... *G07F 17/3241* (2013.01)

(58) Field of Classification Search
CPC ..... G07F 17/3241
USPC ..... 463/29, 13, 16
See application file for complete search history.

(56) References Cited

U.S. PATENT DOCUMENTS

| | | | | |
|---|---|---|---|---|
| 4,405,829 | A * | 9/1983 | Rivest et al. | 380/30 |
| 5,850,447 | A * | 12/1998 | Peyret | 463/29 |
| 6,595,856 | B1 * | 7/2003 | Ginsburg et al. | 463/29 |
| 2002/0169018 | A1 * | 11/2002 | Schneier | A63F 3/081 463/17 |

(Continued)

OTHER PUBLICATIONS

Shamir, Adi; Ronald L. Rivest; and Leonard M. Adleman, "Mental Poker", "Mathematical Gardner", 1981, Prindle, Weber & Schmidt, pp. 37-43.*

(Continued)

*Primary Examiner* — Omkar Deodhar
*Assistant Examiner* — Shauna-Kay Hall

(57) ABSTRACT

Nested commit/reveal sequences using randomized inputs from each participant in a gaming transaction (e.g., the house and each player) may be employed to provide a selection of outcome or outcomes that can be verified by each participant as free from cheating. In general, techniques may be employed in a variety of distributed gaming transaction environments and as a verification facility for any of a wide variety of games in which the risk of player collusion can be eliminated. Nonetheless, several variations on a distributed card dealing method are illustrative and will be appreciated by persons of ordinary skill in the art as applicable in other gaming environments, including games employing outcomes denominated in die (or dice) rolls, coin toss, wheel spins, blind selection or other ostensibly random selection of an outcome from a predefined set thereof.

38 Claims, 5 Drawing Sheets

(56) References Cited

U.S. PATENT DOCUMENTS

| | | | | |
|---|---|---|---|---|
| 2003/0104859 | A1* | 6/2003 | Chaum | G07C 15/00 463/22 |
| 2011/0065491 | A1* | 3/2011 | Wolfe | G07F 17/32 463/17 |

OTHER PUBLICATIONS

Notice of Allowance dated Feb. 21, 2014, mailed in U.S. Appl. No. 13/560,694, pp. 1-30.
Response to Non-Final Office Action dated Oct. 10, 2013, as filed in U.S. Appl. No. 13/560,694 Jan. 27, 2014, pp. 1-3.
Notice of Non-Compliant Amendment dated Jan. 21, 2014, mailed in U.S. Appl. No. 13/560,694, pp. 1-2.
Response to Non-Final Office Action dated Oct. 10, 2013, as filed in U.S. Appl. No. 13/560,694 on Jan. 10, 2014, pp. 1-6.
Non-Final Office Action dated Oct. 10, 2013, mailed in U.S. Appl. No. 13/560,694, pp. 1-5.
Terminal Disclaimer Review Decision dated Sep. 6, 2013, mailed in U.S. Appl. No. 13/560,694, 1 page.
Response to Non-Final Office Action dated May 1, 2013, as filed in U.S. Appl. No. 13/560,694 on Sep. 3, 2013, pp. 1-4.
Terminal Disclaimer as filed in U.S. Appl. No. 13/560,694 on Sep. 3, 2013, pp. 1-2.
Non-Final Office Action dated May 1, 2013, mailed in U.S. Appl. No. 13/560,694, pp. 1-17.
Notice of Allowance dated Apr. 12, 2012, mailed in U.S. Appl. No. 11/234,903, pp. 1-19.
Terminal Disclaimer Review Decision dated Mar. 5, 2012, mailed in U.S. Appl. No. 11/234,903, 1 page.
Response to Final Office Action dated Jan. 18, 2012, as filed in U.S. Appl. No. 11/234,903 on Feb. 29, 2012, pp. 1-5.
Final Office Action dated Jan. 18, 2012, mailed in U.S. Appl. No. 11/234,903, pp. 1-14.
Response to Non-Final Office Action dated May 10, 2011, as filed in U.S. Appl. No. 11/234,903 on Nov. 9, 2011, pp. 1-9.
Non-Final Office Action dated May 10, 2011, mailed in U.S. Appl. No. 11/234,903, pp. 1-26.
Request for Continued Examination (RCE) and RCE Submission, as filed in U.S. Appl. No. 11/234,903 on Jun. 14, 2010, pp. 1-15.
Final Office Action dated Jan. 12, 2010, mailed in U.S. Appl. No. 11/234,903, pp. 1-26.
Response to Non-Final Office Action dated Jun. 10, 2009, as filed in U.S. Appl. No. 11/234,903 on Oct. 13, 2009, pp. 1-9.
Non-Final Office Action dated Jun. 10, 2009, mailed in U.S. Appl. No. 11/234,903, pp. 1-32.
Certificate of Correction dated Dec. 2, 2005, mailed in U.S. Appl. No. 09/740,325, 1 page.
Amendment after Allowance as filed in U.S. Appl. No. 09/740,325 on Aug. 5, 2005, pp. 1-4.
Notice of Allowance dated May 5, 2005, mailed in U.S. Appl. No. 09/740,325, pp. 1-8.
Appeal Brief as filed in U.S. Appl. No. 09/740,325 on Apr. 4, 2005, pp. 1-23.
Final Rejection dated Sep. 2, 2004, mailed in U.S. Appl. No. 09/740,325, pp. 1-13.
Response to Non-Final Office Action dated Jan. 9, 2004, as filed in U.S. Appl. No. 09/740,325 on May 10, 2004, pp. 1-12.
Non-Final Office Action dated Jan. 9, 2004, mailed in U.S. Appl. No. 09/740,325, pp. 1-10.
Request for Continued Examination (RCE) and RCE Submission as filed in U.S. Appl. No. 09/740,325 on Dec. 8, 2003, pp. 1-15.
Examiner Interview Summary dated Nov. 28, 2003, mailed in U.S. Appl. No. 09/740,325, pp. 1-3.
Final Rejection dated Jul. 7, 2015, mailed in U.S. Appl. No. 09/740,325, pp. 1-11.
Response to Non-Final Office Action dated Jan. 9, 2003, as filed in U.S. Appl. No. 09/740,325 on May 9, 2003, pp. 1-5.
Non-Final Office Action dated Jan. 9, 2003, mailed in U.S. Appl. No. 09/740,325, pp. 1-11.
Response to Non-Final Office Action dated Jun. 21, 2002, as filed in U.S. Appl. No. 09/740,325 on Sep. 23, 2002, pp. 1-7.
Non-Final Office Action dated Jun. 21, 2002, mailed in U.S. Appl. No. 09/740,325, pp. 1-10.

* cited by examiner

DISTRIBUTED SECRETS FOR VALIDATION OF GAMING TRANSACTIONS

CROSS-REFERENCE TO RELATED APPLICATION(S)

This application is a continuation of application Ser. No. 13/560,694, filed Jul. 27, 2012, which itself is a continuation of application Ser. No. 11/234,903, filed Sep. 26, 2005, and issued as U.S. Pat. No. 8,231,462, which itself is a continuation of application Ser. No. 09/740,325, filed Dec. 18, 2000, and issued as U.S. Pat. No. 6,949,022 that claims benefit under 35 U.S.C. §119(e) of provisional application No. 60/252,779, filed Nov. 22, 2000. Application Ser. Nos. 13/560,694, 11/234,903, 09/740,325 and 60/252,779 are each incorporated herein by reference.

BACKGROUND OF THE INVENTION

Field of the Invention

The invention relates to validation of distributed transactions, and more particularly, to techniques for detecting cheating in an on-line gaming environment.

Description of the Related Art

The popularity of gambling on the Internet has soared in recent years. Worldwide online gambling was responsible for an estimated two billion dollars of revenue in 1998 and projected 2001 revenues total over seven billion. Traditional gambling is heavily regulated to protect the individual gambler from fraud by casinos. Similar regulations do not yet exist to protect online gamblers. Indeed, significant technical challenges exist to ensuring fair outcomes in which the absence of cheating by the casino (or by players) can be verified. Cheating is a concern for the casinos, as well as for the players. In fact, because of a fear of cheating, existing online casinos often restrict wagering to table games. In general, table games are games where all player information is revealed and only the house has hidden information. The players compete only against the casino, and not against each other. These table games include blackjack, roulette, craps, and Caribbean stud. In contrast, for other games such as poker where players control hidden information, it generally not possible to prevent players from opening another communication channel with which to collude during the course of a game. The colluding players can gain information about the game that would change its outcome, thus cheating. Table games, on the other hand, make player-to-player collusion irrelevant. Players cannot gain information via collusion, because they control no secret information.

A need exists for systems, methods and techniques through which both online gamblers and online casinos can be ensured a "safe", credible area to gamble online. If developed, such systems, methods and techniques could be employed in a wide variety of gaming, entertainment and other applications in which random selections from a predefined set of outcomes play a role.

SUMMARY OF THE INVENTION

It has been discovered that nested commit/reveal sequences using randomized inputs from each participant in a gaming transaction (e.g., the house and each player) may be employed to provide a selection of outcome or outcomes that can be verified by each participant as free from cheating. In general, techniques in accordance with the present invention may be employed in a variety of distributed gaming transaction environments and as a verification facility for any of a wide variety of games in which the risk of player collusion can be eliminated. Nonetheless, several variations on a distributed card dealing method are illustrative and will be appreciated by persons of ordinary skill in the art as applicable in other gaming environments, including games employing outcomes denominated in die (or dice) rolls, coin tosses, wheel spins, blind selection or other ostensibly random selection of an outcome from a predefined set thereof.

One application of techniques in accordance with the present invention is as a distributed card dealing method wherein a dealer (e.g., the house or a separate outcomes generator) shuffles a deck of cards and commits to its order by communicating a secured encoding thereof to each player. Players contribute to the selection of cards from the shuffled deck by each committing to an index contribution by a secured exchange thereof and, after each has committed, revealing and exchanging their respective index contributions. The revealed index contributions may be verified by each player and by the dealer as corresponding to the respective previous commits thereto. In general, the commit/reveal protocol may be provided using any of a variety of techniques including hashing, encryption or any other transform which is generally irreversible and collision intractable given timeframes and computational resources available. Using verifiable index contributions, the dealer performs a predefined combination operation to select and supply a particular card from the deck. Successive cards are dealt using successive index contributions transacted using the commit/reveal sequence therefor. Once the game has been completed in accordance with game logic implementing predefined game rules, the dealer reveals contents of the deck and players may verify that both (i) the cards dealt by the dealer (i.e., revealed in response to the index contributions) correspond to those in the deck properly indexed by the predefined combination operation given the verifiable index contributions and (ii) that the deck was a legal deck (e.g., included each of 52 cards once and only once). As before, the commit reveal protocol may be provided using any of a variety of techniques including hashing, encryption or any other transform which is generally irreversible and collision intractable given timeframes and computational resources available.

In some variations, the dealer need not shuffle the deck, but instead participates in the commit/reveal protocol for index contributions by itself committing and later revealing an index contribution. Although some realizations forward commitments to, and reveals of, index contributions via the dealer or game server itself, other realizations may provide the exchange in other ways, e.g., through a third party or peer-to-peer exchange.

In some variations, rather than incrementally commit, players (and possibly the dealer) may pre-commit to pools of individually secured index contributions and successively reveal their individual index contributions for verification and use in the predefined combination operation to select and supply successive cards from the deck.

In some variations, an ordered deck of individually secured cards may be committed to by the dealer. Thereafter, successive cards selected in accordance with the predefined combination operation and supplied from the deck are individually revealed (e.g., by supply of card-specific keys). Once the game has been completed in accordance with game logic implementing predefined game rules, the dealer reveals the remaining undealt card so that players may verify that the deck was a legal deck (i.e., included each of 52 cards once and only once).

Realizations in accordance with these and other variations will be appreciated by persons of ordinary skill in the art based on the description herein. Several exemplary embodiments are described. However, it is to be understood that both the foregoing general description and the more detailed description that follows are meant to illustrate and explain particular embodiments and do not restrict the scope of the invention(s) as claimed.

BRIEF DESCRIPTION OF THE DRAWINGS

The present invention may be better understood, and its numerous objects, features, and advantages made apparent to those skilled in the art by referencing the accompanying drawings.

FIG. 2B illustrates a functional decomposition in which game logic and outcomes generation are separately realized.

The use of the same reference symbols in different drawings indicates similar or identical items.

DESCRIPTION OF THE PREFERRED EMBODIMENT(S)

The description that follows presents a set of techniques, systems, and functional sequences associated with a distributed gaming transaction environment. An exemplary implementation focuses on an environment in which a traditional table game such as blackjack is provided and cheating may be detected. Accordingly, outcome sets corresponding to decks of cards are used for illustration. Similarly, uses of particular transformational encodings, including cryptographically secured and hashed encodings, are illustrated. Nonetheless, the invention is not limited to the particular outcome sets or transformational encodings illustrated. Rather, based on the description herein, persons of ordinary skill in the art will appreciate a number of suitable variations.

In some realizations, the illustrated techniques are integrated with gaming logic of a gaming transaction server and/or with facilities of a particular gaming interface. On the other hand, some realizations may provide any of a variety gaming applications with an outcome generation and/or validation facility. In general, the techniques, systems, objects, functional sequences and data encodings described herein may be used in combination and/or integrated with applications and/or transaction processing systems. For example, without limitation, realizations in accordance with the present invention may be embodied as (1) functionality integrated or supplied with gaming applications (e.g., as functions, libraries or services of a gaming server or client), as (2) functionality (e.g., as processes, services, etc.) interposed or suitable as an intermediary between gaming applications and an outcome generation facility, or as (3) functionality providing verifiable third party outcome generation for gaming transactions involving a gaming service (e.g., an on-line casino) and players.

In view of the above, and without limitation, the description that follows focuses on an exemplary environment in which verifiable gaming transactions are provided using nested commit/reveal sequences based on encryption and hashing techniques. The description employs terminology particularly appropriate for gaming transactions based on decks of cards. However, these and other embodiments will be appreciated by persons of ordinary skill in the art based on the description and may fall within the scope of the claims that follow.

Distributed Gaming Environment

Figure 1:
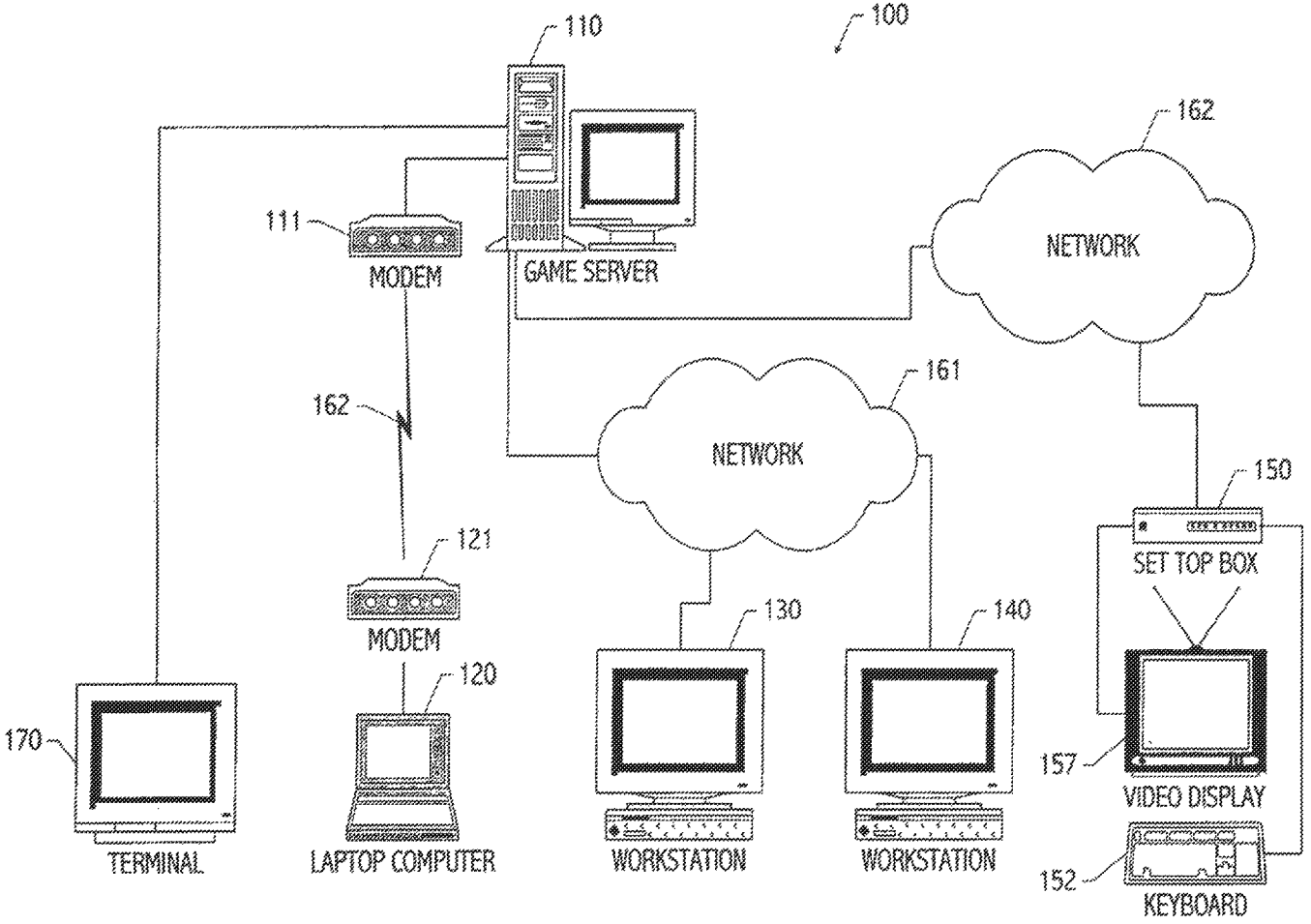
FIG. 1 depicts a distributed environment in which a variety of potential player interfaces are provided.

FIG. 1 illustrates an exemplary distributed gaming environment 100 in which a variety of player interface configurations are supported. For example, in an illustrative realization, game server 110 hosts a software application executable thereon, which implements game logic in accordance with the particular table game or games served thereby. In general, game logic implements the rules, ordering of operations and valuations of outcomes defined by the implemented game and persons of ordinary skill in the art will appreciate a variety of suitable implementations for any given game. Typically, game server 110 also hosts wagering facilities, including in some realizations, interfaces to payment systems such as credit or debit card authorization facilities, and authentication facilities for reliably ascertaining and validating the identity of a player. Game logic may implement certain user interface features or facilities (e.g., preparation and supply of HTML encoded page descriptions) for presentation by a client application such as a browser application. Again, persons of ordinary skill in the art will appreciate a variety of suitable implementations and encodings.

While implementations in accordance with the present invention are not limited to internet-based client-server communications, protocols and applications, web (WWW)-based terminology and facilities are used herein as a context to facilitate description of certain inventive features. Based on that description, persons of ordinary skill in the art will appreciate implementations suitable for a variety of distributed environments including, but not limited to, internet- or web-based environments.

In addition to the more conventional functionality of game server 110, cooperative outcome generation is provided as described herein. Of course, while game server 110 is illustrated in FIG. 1 as a single server, persons of ordinary skill in the art will appreciate that certain functionality thereof may distributed amongst computational platforms. For example, game logic and outcome generation may be separately hosted in some realizations.

Depending on the particular configuration implemented, game server 110 may include facilities for communication with player applications executable at (1) desktop computers (e.g., workstations 130, 140) via electronic communication networks (ECNs) such as the internet, (2) mobile, handheld or laptop computing devices via wired or wireless communication devices and networks (e.g., laptop computer 120 via modems 121, 111 and communications channel 162), (3) entertainment and/or gaming devices such as set top box 150 via communication facilities such as broadband networks, public switched telecommunications networks, wireless, etc.

In addition, some realizations may include support for server-hosted player applications and presentation at device such as terminal 170.

Figure 2A:
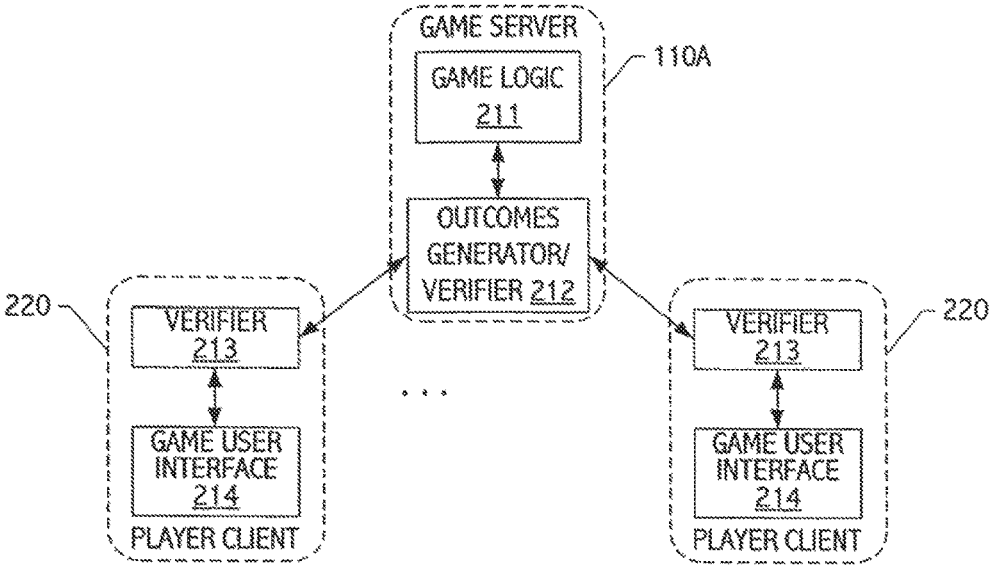
FIGS. 2A and 2B illustrate information flows between components of exemplary functional decompositions in accordance with embodiments of the present invention. In particular.
Figure 2B:
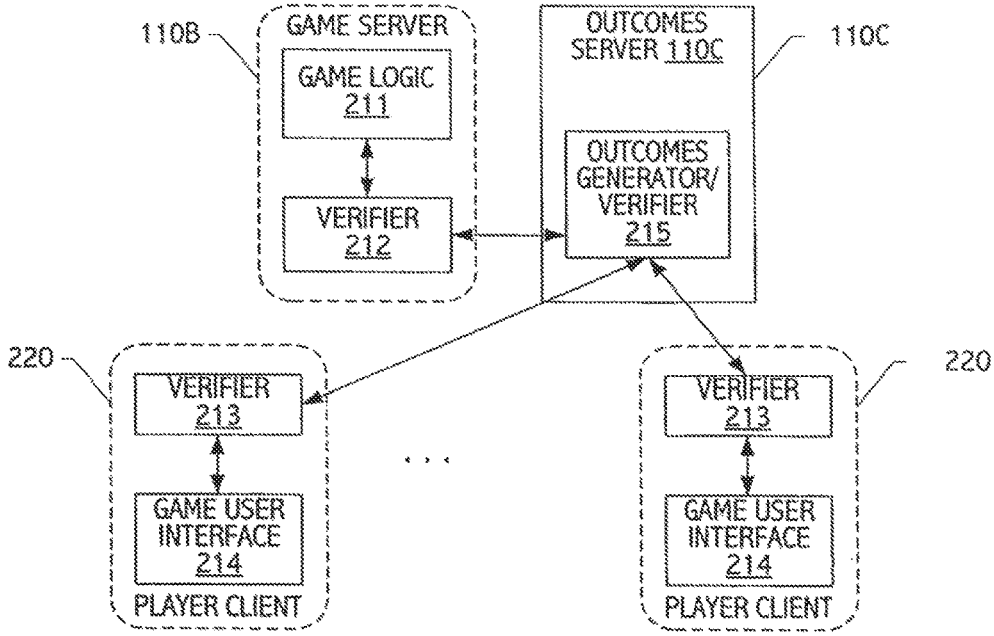

Whatever the particular configuration implemented, game/outcomes server and player client functionality are distributed amongst computational components of the configuration. FIGS. 2A and 2B illustrate some exemplary distributions. Referring to FIG. 2A, game server 110A (including one or more computational resources or components thereof) hosts both game logic 211 (such as described above) and an outcomes generator/verifier 212 (such as described in greater detail below). Player devices or processes (e.g., player clients 220) include a verifier facility (e.g., verifier 213) and a game user interface 214 to allow a human player to interact with game logic and to view progress of a given game in accordance with outcomes generated and verified by respective functionality of game server 110A and player client 220.

Another distribution of functionality is illustrated in FIG. 2B, wherein a separate outcomes server 110C is provided and game server 110B interacts with outcomes server 110C in a manner analogous to that employed by player clients. These and other configurations will be understood in the context of the distributed deal technique now described.

Distributed Deal Technique

Figure 3:
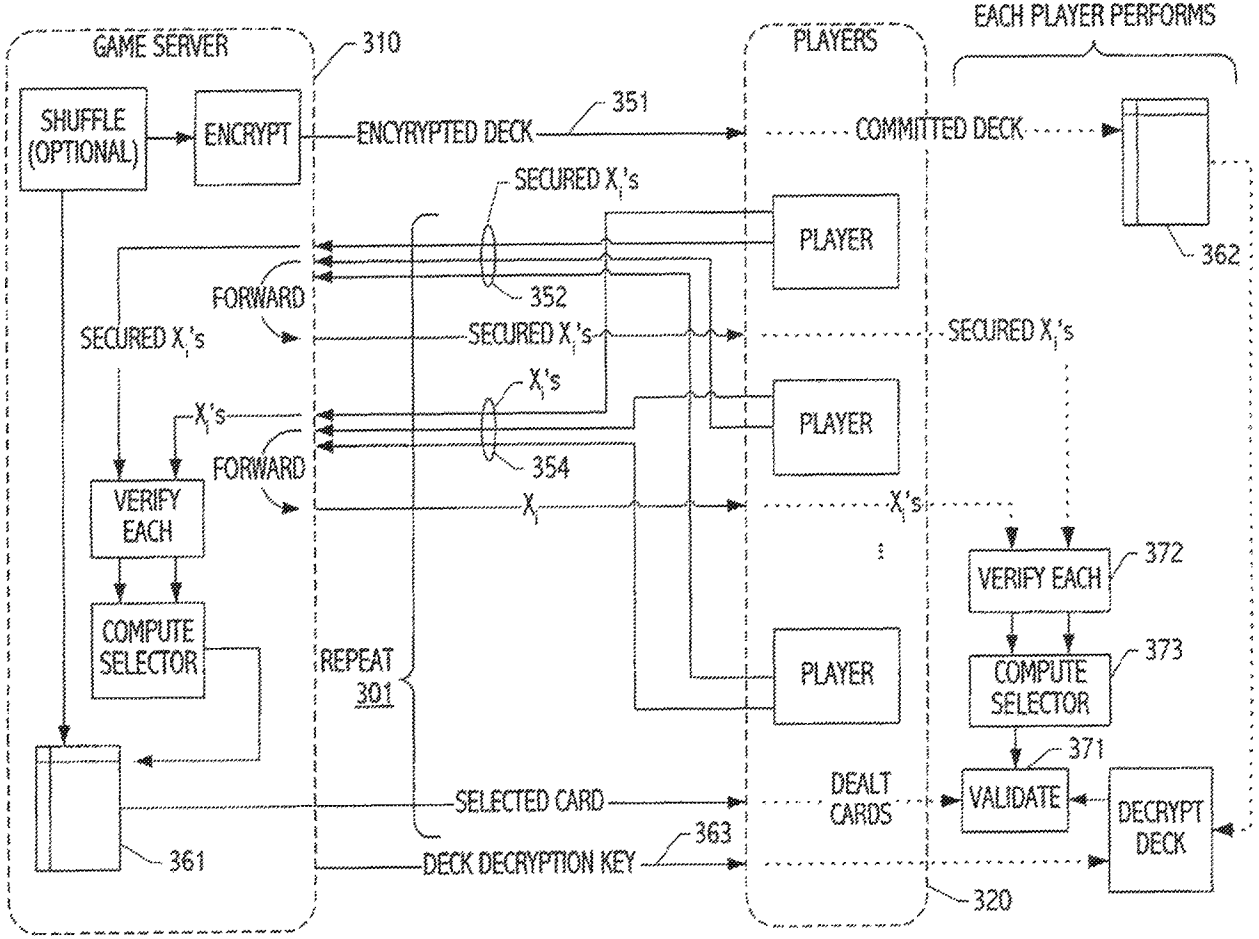
FIG. 3 illustrates information flows between a game server and players in a distributed card dealing realization in accordance with the present invention.
Figure 4:
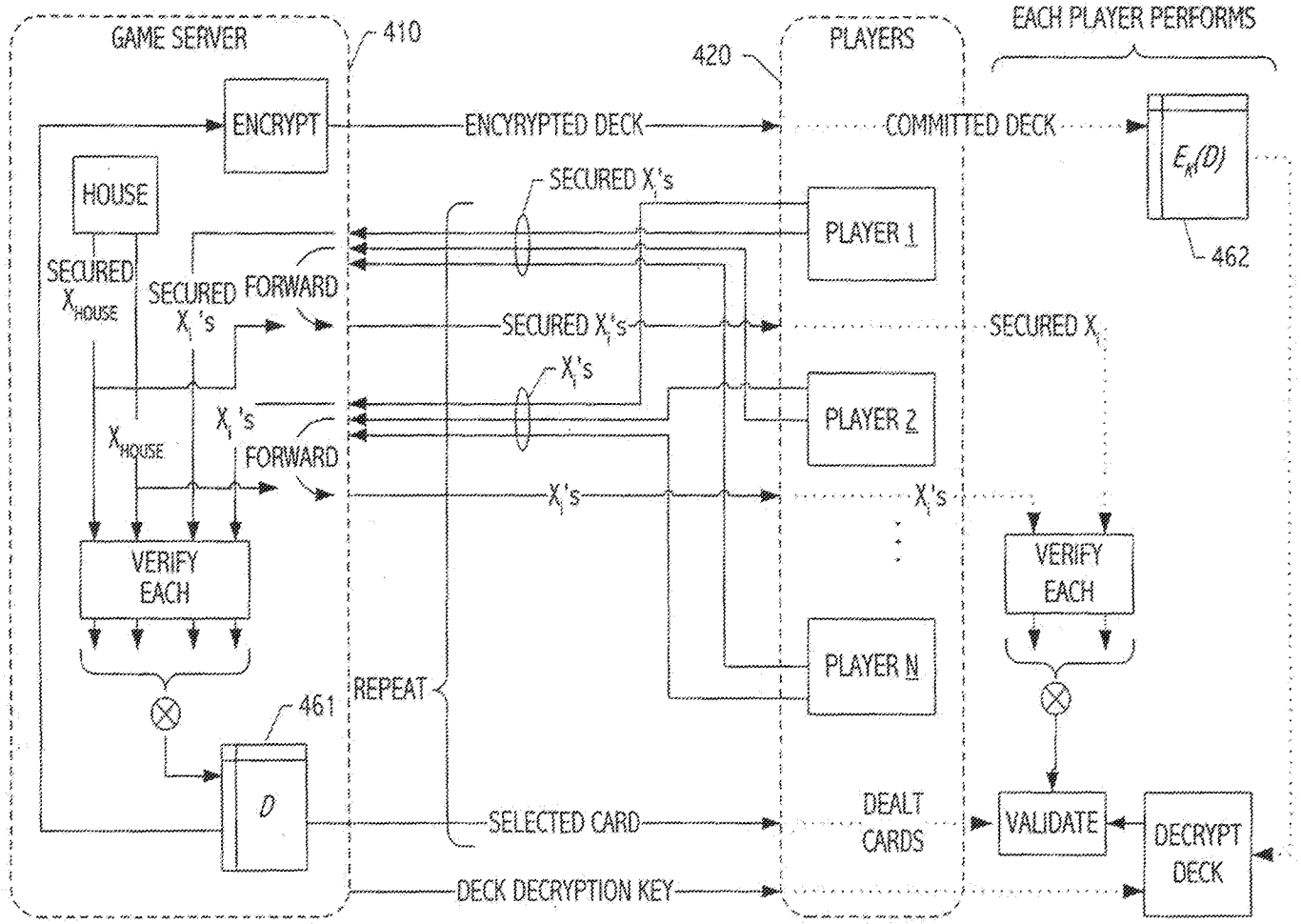
FIG. 4 illustrates information flows between a game server and players in another distributed card dealing realization in accordance with the present invention.
Figure 5:
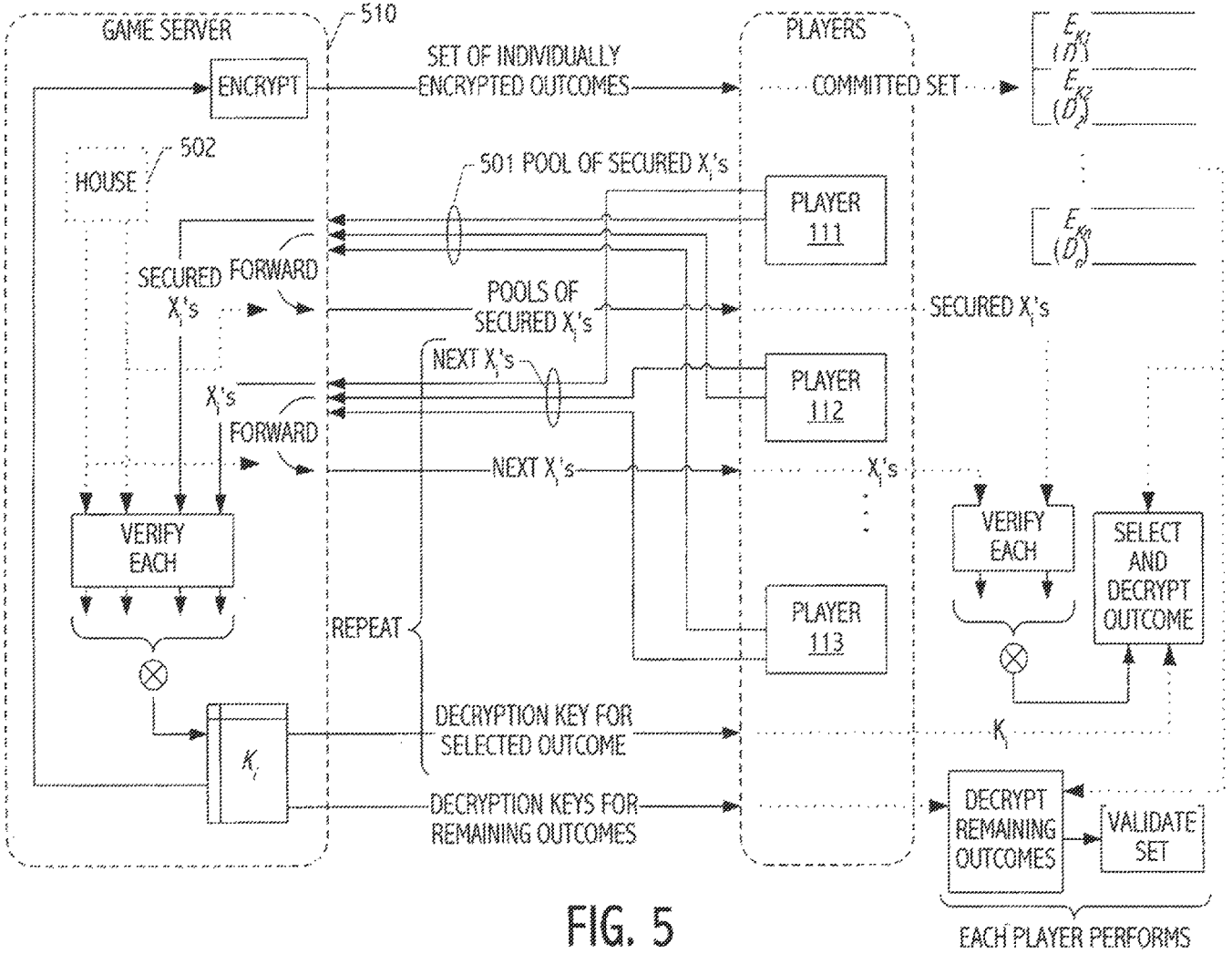
FIG. 5 illustrates information flows between a game server and players in a distributed card dealing realization wherein early departures of a player from a game are tolerated in accordance with the present invention.

FIGS. 3, 4 and 5 illustrate, in the context of various realizations of the present invention, coordination between a game server 310 (which in the illustrated configurations include outcomes generation facilities) and a set 320 of players. In the realization of FIG. 3, game server 310 controls the shuffling of a deck, if any. As described elsewhere herein, some realizations forgo an explicit shuffle of the deck. A hand starts when the game server 310 encrypts a possibly shuffled deck of cards and supplies (351) an encoding of the encrypted deck to all of the players. In this way, game server 310 commits to a particular (and possibly ordered) set of outcomes.

Each time game server 310 wants to deal a card, it uses information received from the players to generate the index of a card in that deck to deal. For example, if based on information from each of the players, a combined index of three is calculated, then the third card (e.g., from the top of the deck) is selected as the next card dealt. Each player is equally involved in the index generation. Index generation can be thought of as a secret-sharing scheme where all players together determine the secret index to be used, or the secret card to be dealt.

Typically, index contributions are prepared in response to a request from game server 310 although other protocols are possible. In an exemplary realization and encoding, when game server 310 requests index contributions so that it can deal a card, each player generates a large number of a predetermined bit length. For example, in one realization, randomized 1024-bit integer encodings are generated. Then, transformationally secured encodings of the large numbers are exchanged (352). In this way, each player commits to its index contribution prior to revealing the contribution and without knowledge of other player's contributions.

In general, any of a variety of transformationally secured encodings may be employed as long as the encodings are generally irreversible and collision intractable given timeframes and computational resources available. The property of collision intractability ensures that, given a contribution A that transforms to B, it is not computationally feasible to find another contribution C that also transforms to B. A variety of techniques may be employed to secure index contributions. For example, contributions may be transformed using a predetermined hashing algorithm or other Message Authentication Code (MAC) technique and exchanged (in transformed form) as part of a commit cycle, then later exchanged in unsecured form as part of a reveal cycle. Unsecured contributions may then be hashed according to the predetermined hashing algorithm to validate correspondence with the prior commitments. Other techniques may also be employed. For example, cryptographically secured contributions may be exchanged as part of a commit cycle and decryption keys supplied to reveal. While the description that follows presumes a hash or other MAC technique, any of a variety of techniques is suitable and may be employed to implement the desired commit/reveal cycle. In general, tradeoffs between security and computational load will shape the selection of a particular technique.

Referring back to FIG. 3, when each player has obtained the transformationally secured version of the index contribution for every other player, the players then exchange (354) underlying index contributions. In the illustrated realization, game server 310 and each of the set 320 of players may independently verify each index contribution against respective commitments thereto. In hash-based realization, a rehash and compare is generally sufficient; whereas in cryptography-based realizations other methods such as use of digital signatures and/or key exchange may be employed.

Whatever the particular commit/reveal protocol employed for index contribution exchange, contributions of the various players are combined to compute a selector into the committed deck. In one realization, the combination is computed using an N-way, bit-wise exclusive-OR (XOR) of binary encodings of the index contributions. Other combining operations may also be suitable. For example, a bit-wise exclusive-NOR (XNOR) operation or arithmetic operations such as an addition or subtraction operation could be employed. In general, suitable operations have the property that no index contribution supplied for combination, by itself or in combination with less than all the other contributions, may limit the range of results. For example, in the case of an XOR operation, no index contribution supplied by any player or any group of players restricts the range of possible XOR results to a subset of all indices. Indeed, since the index contribution of any player may affect every binary digit of the result, no subset of the players may collude with game server 310 to steer dealing to a portion of the deck. Persons of ordinary skill in the art will appreciate combining operations suitable for the particular index contribution encodings and computation environments available.

Typically, index contributions are represented as large bit-length binary encoded numbers that are combined using a suitable combining operation. For example, in some realizations index contributions are encoded as 1024-bit integers and combined using an XOR operation. Typically, for many suitable encodings and combining operations, a large dynamic range result must be mapped onto a much smaller set of outcomes (e.g., a deck of 52 cards). While any of a variety of mappings are suitable, a modulo operation is one attractive option. For example, in some realizations, the combined index, modulo the number of cards left in the deck, is used to index a particular card to be dealt from the deck.

Referring back to FIG. 3, game server 310 reveals the indexed card from deck 361. Unless game server 310 is cheating, deck 361 corresponds exactly to committed deck 362. While any of a variety of reveal methods may be employed, the illustrated realization simply supplies an encoding of the indexed card to each of the players 320. Successive cycles (see repeat 301) commit and reveal index contributions and reveal corresponding cards from the committed deck. In the illustrated realization, the players trust game server 310 until the game is over. Eventually, game logic (not shown) indicates an outcome and both the correspondence of dealt cards to corresponding committed values and the validity of the deck itself may be validated.

To complete a game (or portion thereof such as a hand), game server 310 reveals contents of deck 361, which each of the players 320 may then verify against committed deck 362. In the realization illustrated, game server 310 committed to a particular deck by supplying an encrypted copy 362 thereof and reveals same by supplying a corresponding decryption key. As previously described, in general, any of a variety of transformationally secured encodings may be employed to implement the commit/reveal protocol. Suitable transformationally secured encodings need only be generally irreversible and collision intractable given timeframes and computational resources available. That said, an encryption/decryption-based protocol is simple and convenient for committing and revealing contents of the deck. Accordingly, the description that follows assumes an encryption/decryption-based protocol.

Using a revealed deck 361, each of the players 320 may validate (371) each previously revealed card against the corresponding card from the decrypted (374) deck using verified (372) index contributions and the predefined combining operation (373) to calculate the appropriate indices thereinto. In addition, each of the players 320 may validate (371) the contents of the decrypted (374) deck to verify a proper set of outcomes encoded therein. For example, in a game employing a conventional deck of cards each of the players 320 verifies that the deck includes each of 52 unique cards once and only once. Suitable integrity checks for alternative games and alternative sets of outcomes, including outcome sets denominated in shoes of multiple card decks, in die (or dice) rolls, in coin tosses, in wheel spins, etc., will be apparent to persons of ordinary skill in the art.

Distributed Deal Protocol Detail

To facilitate an understanding of one particular realization in accordance with the present invention, more detailed description of a computational model and protocol follows. In addition, based on the computational model and protocol, several advantages and properties of the particular realization are demonstrated. In some cases, these advantages and properties are demonstrated in the form of a proof. As with most proofs, particular behaviors and properties are demonstrated based on invariants, i.e., attributes that are always or never true. Accordingly, the demonstration of advantages and properties of a particular implementation necessarily includes assertions of invariants, i.e., statement that for one very specific realization, certain things are always or never true or must be or behave in a certain way. Persons of ordinary skill in the art will appreciate that such assertions are particular to a specific realization. Other realizations in accordance with the present invention, including other realizations that exhibit the same or similar advantages and properties may violate some or all of the realization-specific invariants. Typically, other sets of invariants will be appropriate for a proof that these other realizations exhibit such advantages and/or properties.

In this regard, the claims that follow define the scope of the invention, not any realization-specific proof or invariants. Accordingly, a particular computational model and proof of certain properties are now provided without limitation on the variety of embodiments in accordance with the present invention. The proofs and particulars of an exemplary computational framework trace to design choices and should not be taken as limitations on the gaming transactions technology described and claimed elsewhere herein. Many aspects of the proofs and exemplary code implementations are not essential to any particular embodiment of the gaming transactions technology.

In view of the above, one particular computational model is now described.

Protocol Distributed Deal Shuffle

SUMMARY: The untrusted server S sends an encrypted, shuffled deck to each player P for use in the next hand.

RESULT: Each player has received the shuffled, encrypted deck that was generated by the server.

1. S shuffles a deck of cards D.
2. S generates a new secret key K.
3. For each player $P_i$, $S \rightarrow P_i : E_K(D)$ Player interaction takes place when cards are being dealt. The players decide at runtime which card out of the deck will be dealt next. The protocol assumes that the players know how many cards remain in the deck. As long as the players know how many cards were in the deck to start, they can easily keep track of the remaining cards since they are involved in the dealing of each card.

Protocol Distributed Deal Card-Dealing

SUMMARY: The players decide which card will be dealt next out of the deck.

RESULT: The server S tells the players which card corresponded to their combined index.

1. Each player $P_i$ generates a large number $x_i$ of a predetermined, common bit length.
2. For each player $P_i$, $P_i \rightarrow S : MAC(x_i)$
3. S sends all the MACs to all the players.
4. For each player $P_i$, $P_i \rightarrow S : x_i$
5. S sends all the numbers to all the players.
6. Everyone verifies that MACs received in step 3 match the numbers sent in step 5 and that their personal MAC and number pair have not been changed.
7. Everyone independently computes $i = (x_1 \oplus x_2 \oplus \ldots \oplus x_n) \bmod (\text{number of remaining cards})$.
8. i is the index of the next card to be dealt.
9. S tells the players which card is at index i.

Finally, the players verify (or optionally verify) that the server did not cheat as it revealed the cards. In other words, the players are able to verify that the cards revealed match the indices generated. Since the players have each index and they have each card, all that is needed is for the server to reveal the key to decrypt the deck. Then, the players can verify that each card was revealed correctly given the indices that were generated.

Protocol Distributed Deal Verify

SUMMARY: The server S sends the key for the encrypted deck to the players.

RESULT: Each player can decrypt the deck and verify that the game was dealt fairly.

1. For each player $P_i$, $S \rightarrow P_i : K$
2. Each player decrypts the deck and verifies that the cards dealt correspond to the indices generated during the dealing of cards.

Proof of Fairness

Subject to the previous clarification regarding realization-specific proofs and invariants, several advantageous features of realizations in accordance with the above-described computation model may be demonstrated.

Uniqueness of Cards

If a card existed in the deck twice, the players will be able to catch this since they get a key to decrypt the deck when the game is over. However, it might be the case that the deck the server gives the players does not match the deck that he is dealing from. If this is the case, then during the verification step, the players will be able to see that the cards dealt during the game do not match the encrypted deck that they were initially given.

Random Distribution of Cards

No proper subset of the players can determine the next card to be dealt. Each player generates only a part of the final index of the next card. Since all individual parts are XORed together, no proper subset of players can have any knowledge of how their numbers will affect the final index. Each player's number can change every bit of the final index. Furthermore, in the final XORed composition, each bit has probability ½ of being set. This means that all numbers are equally likely to be generated.

Since all communication with other players goes through the server, the server might change the values being given from some or all of the other players. If this happens, either the {MAC, number} pairs that the server has substituted will be valid or they will not. If the server-substituted pair is not a valid {MAC, number} pair, then the player receiving the bogus information will immediately know that someone is attempting to cheat. The player will not know whether the cheating was being done by another player or by the server, but he will know that someone attempted to cheat. If the {MAC, number} pair is valid, then the player will not know that the server has made any changes. However, this does not actually affect the fairness of the game. Looking at this in the extreme case, where the server changes the values being given by all other players, the game simply reverts to the case where it is a single player against the server. Each player might think that they are playing with a group of people, but in each game different cards will be dealt. These cards will still be randomly distributed, however. This is because the player can trivially detect when the server changes the index that he or she generates. In the more general case, if the server changes the numbers generated by player $P_i$, the game progresses fairly just as if player $P_i$ were not in the game.

In general, if the server attempts to change the MAC and/or the corresponding number of any subset of the players, either the remaining players will detect cheating or the game will revert to a state where that subset of affected players was essentially playing a different game.

Secrecy of Deck

Since the server does not reveal the key to the encrypted deck until the hand is completed, the order of cards in the shuffled deck is kept secret from the players during the course of a hand. Only when the hand is finished do the players discover the order of the original deck. Of course, this property relies upon the strength of the encryption algorithm used by the server.

Absence of a Trusted Server

Distributed Deal only relies on the server to participate in the protocol. The server is able to cheat at its discretion by sending invalid values at any stage in the protocol. As shown in the next section, however, any attempt to cheat will be caught by the players. Under the protocol, we assume, and tolerate the possibility that, the server may be revealing hidden information to any of the players or that the server might be dealing invalid cards.

Cheating Detection

Server Cheating: It has already been shown that the server cannot effectively change the {MAC, number} pairs of any of the players. If it does so, then it will either be caught cheating or it will gain no advantage. It will now be proven that given fairly generated indices, it is still not possible for the server to cheat. One way for the server to do this would be to simply ignore the resulting index, and deal a card of its choice. However, since the server must reveal the deck when the game is over, the players will catch this type of cheating when the hand is completed.

A second way that the server might attempt to cheat would be by revealing its hidden information to a proper subset of the players. This will neither help nor hurt the remaining players. Since every player is involved in the index generation, and since every player's input can change every bit of the index, even leaving one player out of the collusion will result in random cards being dealt. Of course, this breaks down when the server colludes with every player. If everyone had all the information, the players could cause the server to deal any card they choose. However, this degenerates to a game where everyone (including the server) is playing together, which is not a very interesting game. Further, if the server decides to collude, it has no guarantee that the player will not collude against the server with the remaining players. Thus, it is actually in the server's best interest not to collude.

Hence, it is not possible for the server to cheat because:

1. It is not possible for the server to change the individual number-MAC pairs without being detected.
2. The server cannot deal an incorrect card without being caught.
3. The server cannot effectively collude with any of the players.

Player Cheating:

It must still be shown that the players cannot cheat against the server. For instance, all the players could collude to create an index of their choice. This means that, since the server cannot cheat on its own, it is in the server's best interest to actually shuffle the deck. Otherwise, the players could play optimally as they would know the next card to be dealt.

The second way that a player could cheat would be to pre-compute the encrypted values of all decks. However, since there are 52 cards in a standard deck, there are 52! possible orderings of that deck, meaning that it takes a minimum of 226 bits to represent a shuffled deck. To store every permutation of 226 bits would take approximately $1.58\times10^{52}$ exabytes (an exabyte is $2^{60}$ bytes) of data storage. Even if this much data could be stored, it could not possibly be searched in the time it takes to play a hand. Further, often more than one deck is used for play.

The final way that a player could cheat would be to somehow construct his part of the index knowing what every other player had picked. If this could be done, then the server could collude with that player to choose which cards to deal. In order to prevent this, MACs of the numbers are first exchanged. Furthermore, the numbers must be sufficiently large so that the players cannot compute all possible MACs ahead of time. In our implementation we used a number that was 1024 bits long to avoid this mode of cheating.

A simpler protocol that may appear to work would be simply to let each player choose the index for his own cards by himself. The card corresponding to the player's chosen index will be as random as the server's shuffle. The problem with this protocol is a subtle one. Though the server and a subset of players cannot directly affect the cards that another player will get, they can indirectly affect it. Consider the following scenario. Player A is working with the server. Player B would like to get an ace. The server tells player A which indices to choose so that player A gets aces. Since player A and the server are working together, transactions between them do not directly help or hurt either one. However, the server and player A have worked together to lower the probability that player B will get an ace. Player B's card is still random, but the remaining contents of the deck are not. Fortunately, the Distributed Deal method handles this case. By giving all participants an equal say in which cards will be dealt, it is impossible for any proper subset of the participants to sway which cards will be dealt.

Advantages

One notable feature of this protocol is that players may leave in the middle of a hand. If, during the course of a hand, a player loses his connection with the server, the game can continue. The only change is that fewer numbers will be composed together to create the final indices. Such a scenario may actually be quite common in some game implementations. For example, in a Blackjack implementation, it is very likely that if a player busts, he will simply terminate his connection without waiting for the game to end for all the other players. The Distributed Deal's ability to handle this case makes it an attractive candidate for real world implementation.

Caveats

The method for generating random indices is not perfect. Assume that you have a random number generator for number between 0 and n, but you need a random number between 0 and x. Under these constraints, if you want a truly random number [0,x], you might have to regenerate as many as n+1 (mod x+1) results from your random number generator. This is because the mod operator used to convert the numbers from the range [0,n] to [0,x] when n>x is not perfectly uniform. So under the Distributed Deal method, it might be necessary to request that the players regenerate the index of the next card to be dealt. Such regeneration does not, however, create an opening for cheating since the players know as well as the server when the index needs to be regenerated.

Tradeoffs

There are several choices to be made for the implementation of the Distributed Deal method. These tradeoffs are typically between speed and security. Based on the description herein, persons of ordinary skill in the art will appreciate suitable tradeoffs for a given implementation environment.

The first such tradeoff has to do with the bit length of the numbers generated by each player. Obviously, making the length of these numbers shorter leads to several speed improvements. Generating the MACs for smaller numbers would take less computation time. Also, transferring shorter numbers over the network may require fewer packets. This may be especially important if any players are using a slow network connection.

On the other hand, the security benefit of longer numbers was already discussed. It prevents players from attempting to compute the MAC of all possible numbers. However, it is somewhat surprising to discover that longer numbers can also improve speed, by decreasing the number of index regenerations, which are very costly. As the size of the numbers grows, the proportion of numbers that call for a regeneration shrinks. In fact, the probability of needing regeneration can be made arbitrarily small by increasing the length of numbers.

The second major choice that will affect performance of the Distributed Deal method is choice of commit algorithm. There are many choices for both the encryption algorithm and the MAC algorithm. Any encryption algorithm can be used whether it is public-key or symmetric-key; block or cipher. Furthermore, the algorithm itself does not need to be overly robust or secure since it only needs to last the length of one hand. This means that as long as it cannot be cracked in a matter of minutes, any encryption algorithm will work. In one realization, DES encryption is employed despite its weakness when compared to more sophisticated techniques.

Furthermore, the use of encryption versus MAC hashing is arbitrary in the Distributed Deal method. One could be substituted for the other. Their purpose in both parts of the algorithm is the same: to temporarily hide information from the other players to guarantee that they choose their actions before knowing yours.

Alternative Distributed Deal Techniques

FIGS. 4 and 5 illustrate several variations on the previously described techniques. First, as previously described, some realizations may forgo shuffling of the deck (or more generally, of outcome sets). FIG. 4 illustrates one such realization. While overall operation of the nested commit/reveal protocols is analogous to that described above with reference to FIG. 3, randomization of the ordering of cards in deck 461 (and in its committed, encrypted counterpart 462) is eliminated. Instead, game server 410 contributes to index generation as yet another source of index contributions. Accordingly, like players 420, game server 410 (notionally, "the house") participates in the commit/reveal protocol for index contributions. First, game server 410 commits to an index contribution. Then, only after all participants (i.e., all players and the house) have committed to respective index contributions, game server 410 reveals its index contribution. In the realization of FIG. 4, game server 410 receives and forwards hashed index contributions (including from the house) and thereafter receives and forwards revealed (unhashed) index contributions, although as previously described, other transfer mechanisms and transformational encodings may be employed.

FIG. 5 illustrates several additional variations on the previously described techniques. In particular, the illustrated technique (i) individually secures outcomes of the committed set (e.g., individually encrypts cards of a committed deck) and (ii) employs a commit/reveal protocol for index contributions wherein each participant pre-commits to a pool of index contributions that may later be individually revealed and employed in outcome selection (e.g., dealing) operations. As before, game server 510 may explicitly randomize its set of outcomes prior to commitment, or may participate in the selection protocol to achieve a similar result.

The realization of FIG. 5 addresses some important real-world considerations. Since servers may not want to shuffle the deck after every hand (e.g., in some implementations a casino may want to deal 80% of a six deck shoe), the previously illustrated algorithm would force players to stay in the game until the server was ready to shuffle before they could verify fairness. To address this limitation, alternative realizations no longer secure the committed set of outcomes, but instead, secures the individual outcomes of the committed set. For example, in a card game implemented in accordance with the illustration of FIG. 5, game server 510 no longer encrypts a deck, but instead encrypts individual cards thereof. Accordingly, when a card is dealt, game server 510 supplies the players with the key for the dealt card. Players can then decrypt the card and verify that successively revealed cards are correct and that the game is fair.

The use of pre-committed pools 501 of index contributions addresses performance issues. Rather than having each player generate and exchange a MAC-index contributions pair at the time a card should be dealt, each player can generate a pool of MACs corresponding to index contributions, exchange all of the MACs up front, and then reveal the successive index contributions as the cards are dealt. This approach cuts the network traffic in half each time a card is dealt at the expense of a larger payload when the MACs are initially exchanged. In general, players (and the house 502, if included in index generation) generate MAC-index contributions and periodically exchange a pool of MACs. The number of pairs generated and/or exchanged can be fixed or determined by game server 510.

As before, some aspects of the alternative realization may be better understood in the context of a particular computational model, which is now described.

Protocol Distributed Deal MAC Exchange

SUMMARY: Each player P generated n indexes (where n is determined by a server S) and sends the MAC of each index to the other players.

RESULT: Each player has received the pool of MACs from every other player.

1. $S \rightarrow P_i$:n
2. Each player $P_i$ generates n large numbers of a predetermined, common bit length.
3. For each player $P_i$, $P_i \rightarrow S$:MAC($x_i$)
4. S sends all the MACs to all the players.
5. Each player verifies that its MACs has not been changed by the server before being advertised.

Shuffling (if employed) reflects that individual cards are encrypted not an entire deck.

Protocol Distributed Deal Shuffle

SUMMARY: The untrusted server S sends an encrypted, shuffled deck to each player P for use in the next hand.

RESULT: Each player has received the shuffled, encrypted deck that was generated by the server.

8. S shuffles a deck of cards D.
9. S generates a new secret key $K_i$ for each card in the deck.
10. For each player $P_i$ and for each card $c_i$, $S \rightarrow P_i$:$E_{Ki}(c_i)$ The dealing of cards is updated to reflect a technique wherein MACs are pre-exchanged and do not need to be advertised for each card dealt.

Protocol Distributed Deal Card-Dealing

SUMMARY: The players decide which card will be dealt next out of the deck.

RESULT: The server S tells the players which card corresponded to their combined index.

1. Each player $P_i$ selects the next unused index $x_i$ out of their pre-generated pool.
2. For each player $P_i$, $P_i \rightarrow S$:$x_i$
3. S sends all the numbers to all the players.
4. Everyone verifies that corresponding MACs received in the MAC-exchange step match the numbers sent in step 2.
5. Everyone independently computes $i=(x_1 \oplus x_2 \oplus \ldots \oplus x_n)$ mod(number of remaining cards).
6. i is the index of the next card to be dealt.
7. S tells the players which card is at index i and the corresponding key $k_i$ of that index.
8. Each player decrypts the card at index i and verifies that it matches the card sent by the server in step 7.

For verification, game server 510 now needs to tell the players the keys for the remaining cards in the deck. Players have already verified the cards that were dealt, so they now only need to verify that the deck itself was complete. For instance, they need to check that no cards were missing.

Protocol Distributed Deal Verify

SUMMARY: The server S sends the remaining keys for the encrypted deck to the players.

RESULT: Each player can decrypt the deck and verify that the deck was complete.

1. For each player $P_i$ and each undealt card $c_1$, $S \rightarrow P_i$:$K_i$
2. Each player decrypts the remaining cards in the deck and verifies that the deck contained all the expected cards and no duplicate cards.

Implementation Frameworks

A variety of implementation frameworks are envisioned. For example, some implementations may embed a verifier software component in accordance with the present invention in a client application. Protocol modules may be plugged into the verifier software component to implement the desired commit/reveal protocol, transformations, etc. In some realizations, it may be desirable that a verifier software component be implemented and/or supplied by a trusted third party (possibly a gambling regulatory group or agency). In this way, users do not need to understand the algorithm. They need only to trust that the third party understands the algorithm and that the third party's program is ensuring a fair game. Casinos could implement their own user interface and the verifier could be pluggable between the server and a user interface (UI). Similarly, server-side outcome generation and index contribution facilities could be implemented as a separable component (e.g., implemented and/or supplied by a trusted third party) for integration with game logic. Also, as previously described, outcome generation components may be hosted together with game logic or, in some realizations, as a separate service. In some realizations, a generic outcome generation service could be hosted (e.g., by a trusted third party) for use in a variety of gaming environments.

While a variety of implementations in accordance with the present invention are possible, certain implementations raise practical issues to be addressed in the particular implementation framework. Based on the description herein, persons of ordinary skill in the art will appreciate suitable customizations for particular implementation frameworks. For example, one reasonable customization stems from the discovery that when players can disconnect at any time, the server has an opportunity to cheat. For example, if a player disconnected after the server has told the players it's time to send their indexes, no index will be received from that player. At this point there are two options. Either the remaining players can ignore the missing index (which will result in a different, but still random index), or the remaining players can retry (this time without the disconnected player) using the next index in their pools. Unfortunately, both of these situations introduce a possibility of cheating by the server. Since the server is receiving all the indexes first, it knows which card will be dealt before the players do. If it doesn't like this card, it can purposefully disconnect a player to change the index and the card that is dealt.

To address this issue, verifiers in implementation frameworks in which early player disconnect is a possibility may connect to each other via another communications path, e.g., in a peer-to-peer network, as well as to the server. This way, the verifiers can exchange the indexes amongst themselves before sending the result to the server. Now, the server cannot change the index even if a player is disconnected. If a verifier gets disconnected while indexes are being exchanged amongst the verifiers, each player can safely ignore the missing playing without fear that the server is cheating.

Other Embodiments

While the invention has been described with reference to various embodiments, it will be understood that these embodiments are illustrative and that the scope of the invention is not limited to them. Many variations, modifications, additions, and improvements are possible. For example, a variety of games may be supported including distributed implementations of casino games, board games, role playing games, etc. In addition, transformational encodings other than the encryption-based and hash-based techniques detailed herein may be employed. Similarly, other commit/reveal protocols, including protocols mediated by third parties, may be employed.

More generally, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Structures and functionality presented as discrete components in the exemplary configurations may be implemented as a combined structure or component. These and other variations, modifications, additions, and improvements may fall within the scope of the invention as defined in the claims that follow.

What is claimed is:

1. A method of facilitating verifiable gaming transactions in a distributed gaming transaction environment, the method comprising:

performing, by a non-transitory, gaming transaction server programmed with code stored in a memory and executing by a processor of the gaming transaction server in a distributed gaming transaction environment that provides a set of outcomes that are verifiable of fair gaming transactions:

executing nested first- and second-type commit/reveal sequences, wherein the first-type commit/reveal sequence commits an outcome generator of the gaming transaction server to the set of outcomes, and instances of the second-type commit/reveal sequence commit at least each player to a respective index contribution and only thereafter reveal the respective index contributions;

selecting from the set of outcomes based on a predefined operation using the index contributions; and thereafter revealing the set of outcomes for validation thereof.

2. The method of claim 1, wherein the set of outcomes correspond to card values from one or more decks thereof.

3. The method of claim 2, wherein the cards values are shuffled.

4. The method of claim 2, wherein the card values are unshuffled, but the predefined combination operation further operates on an index contribution of the outcome generator.

5. The method of claim 1, wherein the set of outcomes correspond to a set of values at least partially defined by one or more of:

a deck of cards;

sides of a die;

sides of a coin; and slots of a wheel.

6. The method of claim 1, wherein the first-type commit/reveal sequence includes:

encryption of the set of outcomes;

supply of the encrypted set of outcomes to each of the players; and later access to the set of outcomes using a key.

7. The method of claim 1, wherein the first-type commit/reveal sequence includes:

encryption of individual ones of the outcomes;

supply of the ordered set of encrypted outcomes to each of the players; and later access to the selected outcomes using respective keys.

8. The method of claim 1, wherein the second-type commit/reveal sequence includes:

hashing of respective index contribution using a predetermined hash;

supply of the hashed index contributions to the outcome generator and to all of the players; and later supply of the index contributions to the outcome generator and to all of the players.

9. The method of claim 1, wherein the first- and second-type commit/reveal sequences include respective transformational securings selected from the set of cryptographic encodings, hashes and irreversible transforms.

10. The method of claim 1, wherein the first-type commit/reveal sequence is performed substantially by a game processor; and wherein the second-type commit/reveal sequence is performed substantially by respective player processors.

11. The method of claim 1, wherein the gaming transaction environment comprises a set of virtual deck of playing cards and the set of outcomes corresponds to an order of the deck of playing cards.

12. A verifiable gaming transactions method comprising:

performing, by a non-transitory, gaming transaction server programmed with code stored in a memory and executing by a processor of the gaming transaction server in a distributed gaming transaction environment that provides a predetermined set of outcomes that are verifiable of fair gaming transactions:

transformationally securing an encoding of the predetermined set of outcomes;

supplying one or more computer systems of players in the gaming transaction with the transformationally secured encoding;

receiving a transformationally secured player index from each of the one or more computer systems of players in the gaming transaction; and selecting a particular one of the outcomes for revealing to the one or more computer systems of players in the gaming transaction based on a combination of the player indices.

13. The method of claim 12, wherein the predetermined set of outcomes is transformationally secured using a cryptographic key; and wherein the player indices are transformationally secured using a hash.

14. The method of claim 12, further comprising:

receiving and verifying the player indices against respective transformationally secured player indices prior to the outcome selecting.

15. The method of claim 12, further comprising:

randomizing ordering of the predetermined set of outcomes prior to the securing thereof.

16. The method of claim 12, further comprising:

effectively randomizing the set of outcomes by further combining the player indices with a randomized index.

17. The method of claim 12, wherein the combination includes a bit-wise exclusive OR of binary encodings of the player indices.

18. The method of claim 12, wherein the selecting includes a modulo function.

19. The method of claim 12, wherein the transformational securing of the predetermined set of outcomes includes cryptographically securing the set of outcomes.

20. The method of claim 12, wherein the transformational securing of the predetermined set of outcomes includes cryptographically securing individual outcomes of the set thereof.

21. The method of claim 12, wherein the gaming transaction environment comprises a set of virtual deck of playing cards and the set of outcomes corresponds to an order of the deck of playing cards.

22. A verifiable gaming transactions method comprising:

performing, by a non-transitory, gaming transaction server programmed with code stored in a memory and executing by a processor of the gaming transaction server in a distributed gaming transaction environment that provides a set of outcomes that are verifiable of fair gaming transactions:

receiving a transformationally secured encoding of a predetermined set of outcomes for a gaming transaction;

supplying a transformationally secured encoding of a player input;

after each of one or more other participants in the gaming transaction has supplied a transformationally secured corresponding input, supplying the player input; and accessing a particular one of the outcomes selected based on a combination of the player input with the corresponding input for each of the zero or more other participants.

23. The method of claim 22, further comprising:

further performing, by the non-transitory, gaming transaction server:

supplying successive player inputs after prior supply and receipt of corresponding transformationally secured inputs; and accessing successive one of the outcomes selected based on combination of the successively supplied player inputs with the corresponding inputs for each of the zero or more other participants.

24. The method of claim 22, wherein the accessing includes receiving an encoding of the particular outcome subject to later verification against the transformationally secured set of outcomes.

25. The method of claim 22, wherein outcomes of the transformationally secured set thereof are individually secured; and wherein the accessing includes obtaining a key for a corresponding individually secured outcome.

26. The method of claim 22, wherein outcomes of the transformationally secured set thereof are individually secured; and wherein the accessing includes receiving an encoding of the particular outcome for verification against corresponding individually secured outcome.

27. The method of claim 22, wherein the gaming transaction environment comprises a set of virtual deck of playing cards and the set of outcomes corresponds to an order of the deck of playing cards.

28. A gaming transaction server in a distributed gaming transaction environment that provides a set of outcomes that are verifiable of fair gaming transactions, the gaming transaction server comprising:

a processor; and a memory, coupled to the processor, the memory including code stored therein and executable by the processor of the gaming transaction server in the distributed gaming transaction environment to provide the set of outcomes that are verifiable of fair gaming transactions, wherein the code comprises:

an outcomes generator for verifiable gaming transactions comprising:

a commitment sequence executable to supply one or more players with a transformationally secured set of outcomes; and a reveal sequence responsive to receipt of transformationally secured player index contributions from each of the one or more players, the reveal sequence executable to select a particular one of the outcomes based on a combination of the player indices.

29. The apparatus of claim 28, wherein the outcomes generator is integrated with, and responsive to, game logic.

30. The apparatus of claim 28, wherein the commitment and reveal sequences employ cryptographic transformations.

31. The method of claim 28, wherein the gaming transaction environment comprises a set of virtual deck of playing cards and the set of outcomes corresponds to an order of the deck of playing cards.

32. A player client computer system in a distributed gaming transaction environment for verifiable gaming transactions comprising:

a processor; and a memory, coupled to the processor, the memory including code stored therein and executable by the processor of the player client computer system in the distributed gaming transaction environment to provide a predetermined set of outcomes that are verifiable of fair gaming transactions, wherein the code comprises a commitment sequence executable, after receipt of a transformationally secured encoding of the predetermined set of outcomes, to supplying a transformationally secured encoding of a player input; and a reveal sequence executable, after each of zero or more other participants in a gaming transaction has supplied a transformationally secured corresponding input, to reveal the player input; and a selector for a particular one of the outcomes based on a combination of the player input with the corresponding input for each of the zero or more other participants.

33. The method of claim 32, wherein the gaming transaction environment comprises a set of virtual deck of playing cards and the set of outcomes corresponds to an order of the deck of playing cards.

34. A method of making a computer-readable encoding of a verifiable gaming outcome in a gaming transaction environment, the method comprising:

performing, by a non-transitory, gaming transaction server programmed with code stored in a memory and executing by a processor of the gaming transaction server in a distributed gaming transaction environment that provides a predetermined set of outcomes that are verifiable of fair gaming transactions:

transformationally securing an encoding of a predetermined set of outcomes;

supplying one or more players with the transformationally secured encoding;

receiving a transformationally secured player index from each of the one or more players;

selecting a particular one of the outcomes for revealing to the one or more players based on a combination of the player indices; and encoding as the computer-readable encoding, information usable by the one or more players to reveal the selected outcome.

35. The method of claim 34, wherein the information encodes the selected outcome.

36. The method of claim 34, wherein the information includes a key to reveal at least the selected one of the outcomes from the supplied transformationally secured encoding thereof.

37. The method of claim 34, wherein the computer-readable encoding includes at least one message suitable for communication between a gaming server and a client thereof.

38. The method of claim 34, wherein the gaming transaction environment comprises a set of virtual deck of playing cards and the set of outcomes corresponds to an order of the deck of playing cards.

* * * * *